United States Patent [19]

Cameron et al.

[11] Patent Number: 4,766,883

[45] Date of Patent: Aug. 30, 1988

[54] FORCED DRAFT CONTROLLED MIXTURE HEATING SYSTEM USING A CLOSED COMBUSTION CHAMBER

[75] Inventors: A. Larson Cameron, Culver City; Henry J. Moore, Los Angeles, both of Calif.

[73] Assignee: Mor-Flo Industries, Inc., Cleveland, Ohio

[21] Appl. No.: 106,930

[22] Filed: Oct. 7, 1987

Related U.S. Application Data

[63] Continuation of Ser. No. 832,992, Feb. 26, 1986.

[51] Int. Cl.[4] ..... F24H 1/00

[52] U.S. Cl. ..... 126/351; 126/361; 126/360 R; 122/182 S; 122/20 B; 122/121; 122/17; 137/98

[58] Field of Search ..... 126/365, 362, 351, 360 R, 126/361, 350 R; 122/182 S, 20 B, 18, 17, 121; 431/89, 90, 328, 329; 137/88, 98, 100

[56] References Cited

U.S. PATENT DOCUMENTS

| | | | |
|---|---|---|---|
| 2,385,854 | 10/1945 | Wolfersperger | 158/99 |
| 2,799,288 | 7/1957 | Knight | 137/98 |
| 3,199,572 | 8/1965 | Boulet | 431/329 |
| 3,741,710 | 6/1973 | Nelson | 431/90 |
| 4,257,355 | 3/1981 | Cook | 126/362 X |
| 4,336,820 | 6/1982 | Jorgensen et al. | 137/100 |
| 4,385,723 | 5/1983 | Sanborn et al. | 126/351 X |
| 4,385,887 | 5/1983 | Yamamoto et al. | 431/90 |
| 4,449,484 | 5/1984 | Sakamoto et al. | 122/13 R |
| 4,541,410 | 9/1985 | Jatana | 126/362 |
| 4,641,631 | 2/1987 | Jatana | 126/101 |

FOREIGN PATENT DOCUMENTS

| | | |
|---|---|---|
| 0104586 | 4/1984 | European Pat. Off. . |
| 0110071 | 6/1984 | European Pat. Off. . |
| 53-24140 | 3/1978 | Japan . |
| 1537239 | 12/1978 | United Kingdom . |
| 1565310 | 4/1980 | United Kingdom . |
| 2177493 | 1/1987 | United Kingdom . |

OTHER PUBLICATIONS

Document entitled, "Negative Pressure Regulators (Zero Governors)", published by Robert Shaw Controls.

Honeywell Publication Form No. 68-0044-2, published by Honeywell, Inc., 1984.

*Primary Examiner*—Randall L. Green

*Attorney, Agent, or Firm*—Body, Vickers & Daniels

[57] ABSTRACT

A high efficiency forced draft water and space heater maintains a desired air to fuel ratio and efficiency in combustion regardless of changes in air inlet pressure. The heater uses a venturi type proportioner and associated fuel regulator to provide an air and fuel mixture of constant ratio which is drawn from the proportioner by a blower and introduced into a closed combustion chamber for efficient burning and heating of a surrounding body of water.

11 Claims, 3 Drawing Sheets

FORCED DRAFT CONTROLLED MIXTURE HEATING SYSTEM USING A CLOSED COMBUSTION CHAMBER

This is a continuation of Ser. No. 832,992 filed Feb. 26, 1986, now abandoned.

FIELD OF THE INVENTION

The present invention pertains generally to water and space heating systems and more particularly to a forced draft high efficiency combined heating system.

BACKGROUND OF THE INVENTION

Water heating appliances and space heating appliances have undergone significant changes over the last several years. In the past, fuel was relatively inexpensive and water heaters and space heaters were designed for maximum reliability, simplicity and long life with only a small emphasis placed on fuel efficiency. This set of priorities has changed with the rising price of fuel. Over the last several years, water heaters and space heating furnaces have been designed with a much greater emphasis placed on fuel efficiency. These heaters are generally more complex than their less efficient ancestors.

An additional development has been the combining of water heating and space heating functions in a single appliance. This combination was developed to improve overall efficiency of the total water heating and space heating function within a given home, commercial building or vehicle. Moreover, savings on the space occupied by these appliances and installation expenses have been achieved by the combination of the two essential appliances into one high efficiency unit.

One such high efficiency combined water and space heating appliance is described in U.S. Pat. No. 4,541,410 to Jatana, the disclosure of which is incorporated herein by reference. Jatana describes a heating apparatus in which air is mixed with fuel and introduced into a blower which moves the mixture under pressure into the burner of a closed combustion chamber. The combustion chamber is contained within a tank containing water. The products of combustion exit the combustion chamber and pass through a helical tube of several turns within the body of water. The heat of combustion is extracted from the products of combustion by conduction through the walls of the combustion chamber and the helical exhaust tube. A high efficiency water heater results. The heated water from the water heater is also used to heat the air of a home or building by piping the hot water to a heat exchanger contained within the ducts of the home ventilation system. While this apparatus provides a highly efficient water and air heater, certain problems remain.

In order to maximize efficiency, the Jatana heater draws combustion air from outside of the home or building being heated. This requires piping or ducts from outside the building to the heater. Such piping or ducts are unique to each building in which the appliance is installed. Air to be mixed for combustion must be drawn through these ducts, and, due to variations in the length of the ducts, turns within the ducts and the like, the resistance of each individual installation to the flow of air will be different. This often requires that valves governing the air supplied to the furnace and gas supplied to the furnace be professionally and individually adjusted for each installation. Any changes in the resistance of the ducts to the flow of air caused by the introduction of foreign objects into the ducts, denting of the ducts or the like after adjustment may cause a change in the ratio of air to fuel in the heater, negatively effecting efficiency.

The burner in the Jatana device is a cylindrically shaped screen contained within a cylindrical combustion chamber. It has been found that the introduction of the air and fuel mixture into this burner under pressure sometimes results in a swirling circumferential motion leading to noisy operation.

In the Jatana unit and in many other high efficiency units several additional problems arise. Thus, air in excess of what is required for proper combustion of the fuel is often mixed with the fuel to be certain that the burner is never supplied with too little air, resulting in incomplete combustion.

Also, the burner of a high efficiency heater normally operates most efficiently at a given gas pressure and a specific energy input level. Variations in gas pressure and variations in energy input level cause reductions in efficiency. Therefore, the capacity, that is the input energy level, of a given furnace or heater cannot be easily adjusted while maintaining high efficiency.

Problems of stability sometimes arise. Conditions in the combustion chamber change because of high outside wind, changes in gas pressure and the like and result in "fast cycling" and other problems which negatively effect efficiency. "Fast cycling" is the rapid and repeated changing of the furnace from the on state to the off state. It is often noisy and inefficient.

The present invention contemplates a new and improved apparatus and method which overcomes all of the above referred to problems and others and provides a water and space heating appliance of high efficiency, reliability, stability and quality.

SUMMARY OF THE INVENTION

In accordance with the present invention, there is provided an appliance for proportioning fuel and air in a precise preselected ratio, pressurizing and mixing such fuel and air and introducing such fuel and air into a closed combustion chamber. The proportioning of fuel and air is accomplished in a venturi type proportioner in which fuel from a fuel regulator is introduced into the stream of air passing through the venturi at the venturi throat section. Pressurizing and mixing of the fuel and air is accomplished in a blower downstream from the venturi proportioner.

Further in accordance with the invention, air pressure is sensed at the venturi air inlet section adjacent to the venturi throat section and such pressure is used to regulate the amount of fuel delivered to the fuel inlet at the venturi.

Further in accordance with the invention, a fuel regulator is provided which regulates fuel flow based on the difference between pressure at the venturi air inlet section and pressure at the venturi throat section, both such pressures being negative with respect to ambient pressure.

Yet further in accordance with the invention, the fuel regulator allows the passage of fuel only in response to a pressure difference indicative of proper air flow through the venturi.

Still further in accordance with the present invention, a combustion chamber is provided with a burner having a cylindrical shape and vertically disposed interior dividers preventing swirling of fluid within the burner.

Still further in accordance with the present invention, the combustion chamber is provided with an electrical igniter outside of the burner and the burner vertical dividers are provided with a deflector adapted to deflect a portion of the air and fuel mixture to the igniter.

Still further in accordance with the invention, a method of proportioning, mixing and combusting fuel and air is provided in which air and fuel are proportioned in a venturi type proportioner prior to being drawn into a blower where the fuel and air are pressurized and mixed and introduced into a combustion chamber.

The principal object of the present invention is the provision of a heater for heating water and air which is highly efficient, precisely controlled and safe to operate.

It is a further object of the present invention to provide a heater having the amount of fuel introduced into the combustion chamber precisely controlled with respect to the amount of air introduced into the combustion chamber regardless of the resistance of the air inlet path, variations in the feed pressure of fuel, variations in line voltage supplied to the furnace blower and other changes in conditions.

It is a further object of the present invention to provide a heater having a homogenized air and fuel mixture of uniform proportions introduced into a combustion chamber for efficient combustion.

It is a further object of the present invention to provide an air and fuel proportioner and fuel flow regulator which will interrupt the flow of fuel to the appliance if appropriate air flow is not present.

Still another object of the present invention is the provision of a heater which operates quietly.

Yet another object of the present invention is the provision of a heater which operates over a wide range of energy input levels while maintaining proper air and fuel proportions without the need to readjust the proportioning apparatus.

Yet another object of the present invention is the provision of a method of combusting fuel and air in which fuel will not be obtained from a fuel line unless proper air flow is sensed.

The invention may take physical form in certain parts and arrangements of parts, the preferred embodiment of which will be described in detail in the specification and illustrated in the accompanying drawings which form a part hereof.

DESCRIPTION OF THE PREFERRED EMBODIMENT

Figure 1:
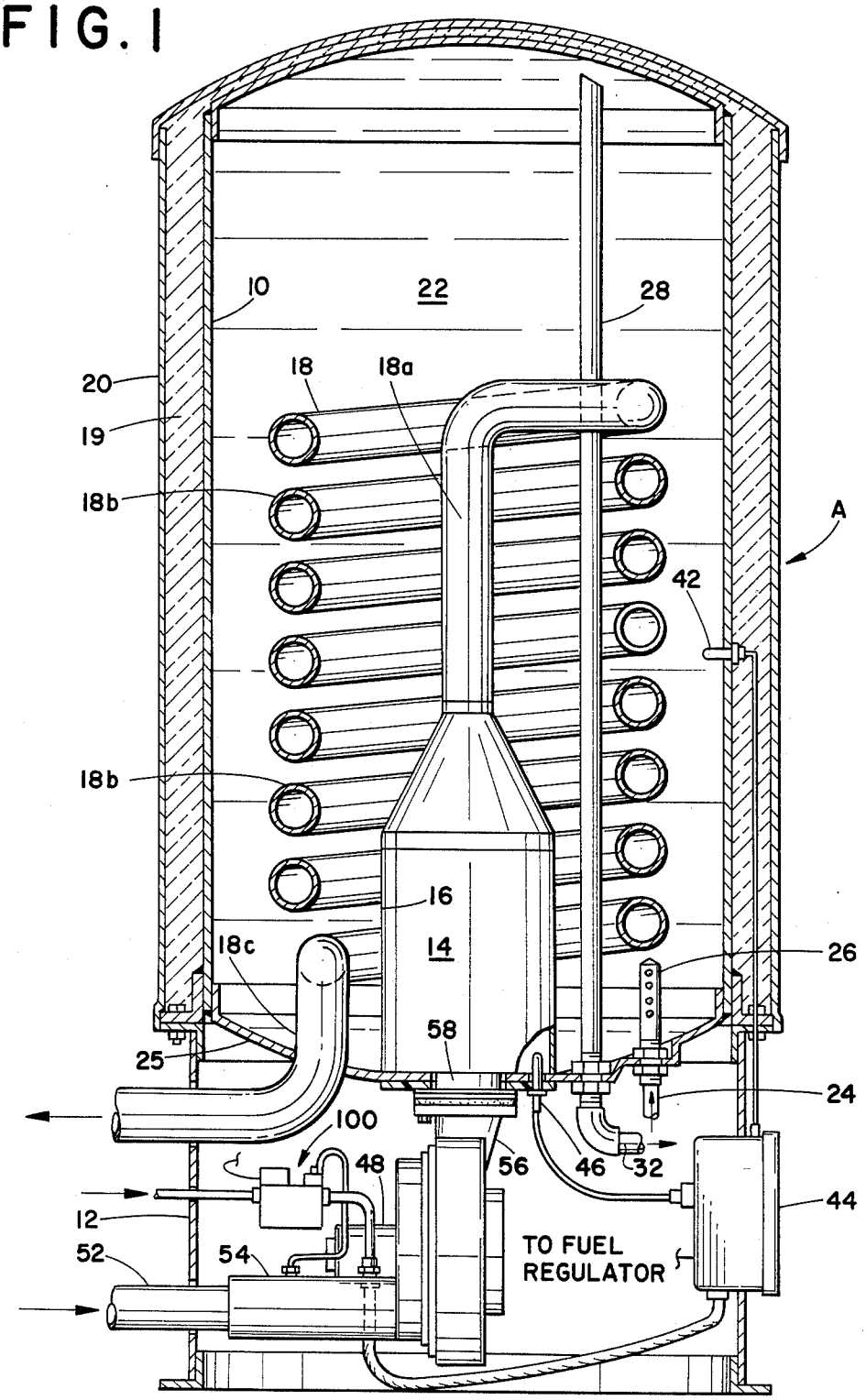
FIG. 1 is a side elevation of a water and air heater, in accordance with the present invention, partially broken away, showing the major elements of the heater.

Referring now to the drawings, wherein the showings are for the purposes of illustrating a preferred embodiment of the invention only and not for purposes of limiting same, the figures show a heater A comprised of a stainless steel water containing tank 10 supported upon a base 12 and containing a combustion chamber 14 surrounded by a combustion chamber wall 16 and an exhaust gas exit tube 18. The water containing tank 10 is surrounded by a layer of insulation 19 and a protective jacket 20 in the conventional manner.

The tank 10 is filled with a stratified body of water 22 with the coldest water remaining in the bottom of the tank and the hottest water rising to the top. The water to be heated is introduced into the water containing tank 10 through inlet piping 24 leading through the bottom plate 25 of the tank and feeding water to an inlet water diffuser 26. The diffuser 26 is a short, closed tube having apertures 27 along one of its side surfaces which introduces water into the tank 10 near its bottom.

Heated water is withdrawn from the tank 10 through an outlet tube 28 which is fixed to a fitting penetrating through the bottom plate 25 of the tank 10 and extends upwardly to the topmost region of the tank 10. The top of outlet tube 28 is open. Heated water passes through this opening into the tube, downwardly through the outlet tube, out of the tank 10 and into the outlet hot water piping 32.

Inlet piping 24 and outlet hot water piping 32 are connected to the domestic water piping of the building in which the heater is disposed thereby supplying hot water. The inlet piping 24 and outlet hot water piping 32 are also connected through appropriate valves to a heat exchanger in the space heating and ventilating system to provide heat for the building in accordance with the teachings of Jatana U.S. Pat. No. 4,451,410.

Heat is provided to the body of water 22 from the heat of fuel combustion in combustion chamber 14. The equipment and method of supplying combustion gases to the combustion chamber will be described below with reference to a system using natural gas as the input energy source. Other fuels, such as bottled propane gas, can be used with only slight adjustments to the system easily accomplished by those skilled in the art. Use of bottled gas in a system such as this is most appropriate in mobile home, camper and marine applications. Both the hot water for domestic use and the interior space heating in such a vehicle is provided by the single heater described herein.

When hot water is withdrawn from the water containing tank 10 through the outlet tube 28, additional cold water is drawn into the tank 10 through the inlet water diffuser 26. When sufficient cold water is drawn into the tank 10, the drop in water temperature is sensed by a water temperature sensor 42. The water temperature sensor 42 is connected to the electric control circuitry contained in an electrical control box 44. Appropriate control circuitry is well known in the art and will not be described in detail herein.

In response to the lowered water temperature within the tank 10, an electric igniter 46 in combustion chamber 14 is turned on. The igniter quickly reaches a temperature sufficiently high to ignite a gas and fuel mixture. A blower 48 is energized and a fuel regulator 100 is turned on. The blower 48 draws air from outside the building or vehicle through air inlet tubing 52 into an air and fuel proportioner 54 where fuel is introduced to the airstream and some mixing occurs. The air and fuel proportioner is described in detail hereafter. The air and fuel is drawn into the body of the blower 48 where it is pressurized and mixed further. A homogeneous air and fuel mixture results.

The blower 48 is a blower in which the air and fuel intake is near the center portion of the blower body and the output is on the outer periphery of the blower. This is important as all bearings and other points at which leaks may develop between the interior of the blower and the exterior of the blower are maintained at less than atmospheric pressure during blower operation. If a leak should develop through the failure of a seal, such a leak would result in a minor addition of air to the air and fuel mixture rather than fuel escaping from the blower.

The pressurized and homogenized air and fuel mixture from the blower 48 is directed through the output horn 56 of the blower 48 into the combustion chamber 14 through a combustion chamber inlet opening 58 in the tank bottom plate.

The Combustion Chamber

Figure 3:
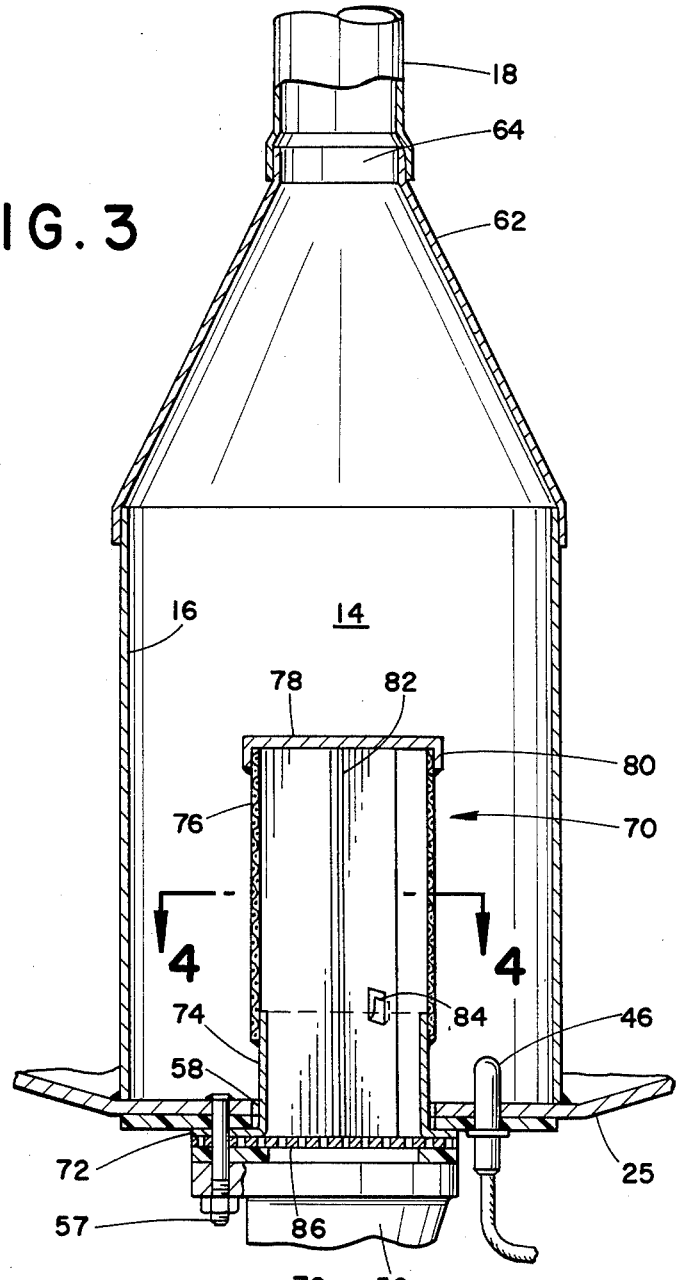
FIG. 3 is a side elevation of the combustion chamber and burner of the device shown in FIG. 1; and, FIG. 4 is a cross sectional view of the burner taken along line 4—4 in FIG. 3.
Figure 4:
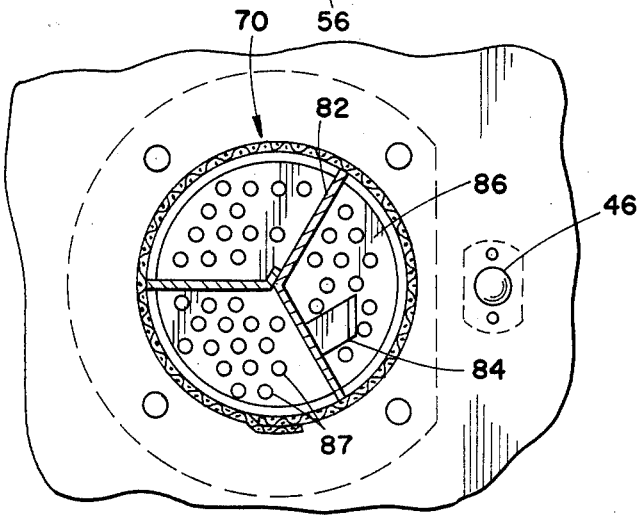

As can be best seen in FIG. 3, the blower output horn 56 is securely fastened to the tank bottom plate 25 by means of studs 57 passing through the flange of the output horn from the bottom plate 25. The blower output horn 56 is aligned with the combustion chamber inlet opening 58. The combustion chamber 14 is contained within a cylindrical combustion chamber wall 16 which is welded around its lower periphery to the bottom plate 25 of water containing tank 10. The top of the combustion chamber 14 is defined by a conical combustion chamber top 62 which is welded to the top of the combustion chamber wall 16. The combustion chamber top 62 is provided with an exhaust aperture 64 which communicates with the exhaust gas exit tube 18, only a small portion of which is shown in FIG. 3. The exhaust gas exit tube 18 is welded to the topmost portion of the combustion chamber top 62. The exhaust gas exit tube 18 is comprised of a short vertical segment 18*a* leading upwardly from the combustion chamber and a helical segment 18*b* spiralling downwardly within the water containing tank 10. The lower end 18*c* of the exhaust gas exit tube exits the tank 10 through the tank bottom plate 25 and is connected to a duct removing exhaust gases from the structure being heated. Like water containing tank 10, the combustion chamber wall 16, the combustion chamber top 62 and the exhaust gas exit tube 18 are all fabricated from stainless steel.

The burner 70 is contained within the lower portion of the combustion chamber 14 and is comprised of a burner mounting plate 72 disposed below the tank bottom plate 25, a cylindrical burner ring 74 which is welded to the mounting plate and which passes through the combustion chamber inlet opening 58, a cylindrical burner screen 76 which is welded to the top of the burner ring, and a burner end cap 78 which is welded to the top of the burner screen. The burner screen is a very fine mesh screen having 0.024 inch diameter holes arrayed in a straight pattern resulting in 517 holes per square inch. The mesh is so fine that only 24% of the surface of the screen is actually open. The burner end cap 78 is circular with a short cylindrical flange 80 depending from its periphery allowing welding of the cap to the screen 76.

Contained within the burner ring 74 and burner screen 76 is a burner divider 82 comprised of three vertical plates radiating from the center of the burner 70 to the surfaces of the burner ring and the burner screen. The burner divider is as tall as the burner itself and divides the interior volume of the burner into three wedge shaped sectors. One of the burner divider plates is provided with a deflector 84 which deflects a portion of the flow of combustion gases toward the igniter 46. All of the elements of burner 70 are fabricated from stainless steel.

A burner distribution plate 86 comprised of a thin sheet of stainless steel having a uniform pattern of small holes 87 therein is disposed just below the burner mounting plate 72 at the interface between the burner 70 and the blower output horn 56. Appropriate gasketing is, of course, inserted in this stack of elements such that the burner 70, burner distribution plate 86 and the blower output horn 56 are firmly and airtightly fixed to the bottom plate 25 of the water containing tank 10.

In operation, the air and fuel mixture from blower 48 is forced through the burner distribution plate 86 into the interior volume of the burner 70. The burner distribution plate 86 assures an even distribution of combustion gases. These gases flow upwardly through the sectors of the burner defined by the burner divider 82. The burner divider prevents the swirling of these combustion gases which might otherwise result in noisy operation.

The combustion gases are forced through the very small openings in burner screen 76 where they are ignited by the existing flame front. Some gases are deflected by the deflector 84 to the igniter 46 to establish this flame front at the beginning of a heater cycle. The fine mesh of the burner screen prevents the migration of the flame front to the interior volume of the burner 70.

The heat of combustion generated outside of the burner screen 76 heats the combustion chamber wall 16 and combustion chamber top 62 and hence, the body of water 22 surrounding the combustion chamber 14. The hot products of combustion exit the combustion chamber 14 through the exhaust gas exit tube 18. As seen in FIG. 1, the exhaust gas exit tube 18 conveys the exhaust gases on a helically downwardly spiralling path through the body of water 22 and hence outside of the water containing tank 10 and outside of the building or vehicle in which the heater A is located. It must be remembered that blower 48 has pressurized the combustion gases, and hence the exhaust gases, allowing the exhaust gases to follow the convoluted and lengthy heat exchange path described above. Forced draft is applied: a natural draft is not required.

The exhaust gas exit tube 18 follows a counterclockwise downward spiral within the tank 10. The apertures 27 in the inlet water diffuser 26 are orientated such that cool water entering the tank 10 flows in a clockwise direction. The cold water is first brought into contact with the lowest and coolest portion of the exhaust gas exit tube 18 and then spirals upwardly in a direction opposite to that of the exhaust gases in the exhaust gas exit tube. This forced counterflow brings the coldest water into contact with the coolest portion of the exhaust gas exit tube 18 and brings progressively warmer water against warmer portions of the exhaust gas exit tube 18. High efficiency heat exchange results.

The Air and Fuel Proportioner

The proportioning of fuel to air in a heater is critical to its efficiency. In the heater A being described, proportioning is accomplished in the air and fuel proportioner 54 (best seen in FIG. 2) which is positioned in the air stream just prior to the blower 48. A gas pressure servo regulator 100 available from Robertshaw Controls Co. and others operates in concert with the air and fuel proportioner 54.

The positioning of the air and fuel proportioner 54 on the inlet side of the blower 48 is important. In the past, it has been suggested to use an air and fuel proportioner to mix fuel with air after the air has been pressurized in a blower. Such an arrangement can result in incomplete mixing of the air and fuel. There can be rich parts and lean parts in the flow. While an elaborate proportioner design could be made to mix better, the present invention allows the use of a less complex proportioner. Moreover, placing the proportioner 54 on the inlet side of the blower 48 allows the proportioner 54 to operate correctly with almost any fuel supply pressure.

The possibility of dangerous leaks of fuel to the atmosphere is reduced when the air and fuel proportioner performs its function at less than atmospheric pressure. With the air and fuel proportioner 54 on the inlet side of the blower 48, the pressure in the air and fuel proportioner 54 is maintained at less than atmospheric pressure by the suction of blower 48. A leak will result in a minor addition of air to the air and fuel mixture. If the air and fuel proportioner were located on the output side of the blower, pressures in the proportioner would be higher than atmospheric and leaks would result in fuel entering the atmosphere around the heater A.

The gas pressure servo regulator 100 is somewhat conventional but interacts with the air and fuel proportioner 54 in a novel manner. The servo regulator 100 is comprised of a main valve diaphragm 102 which controls the flow of gas from the servo regulator gas input 104 through a main valve aperture 106 to the servo regulator output 108. A pressure sensing regulator valve 110 regulates a small control flow from a main bleed line 112 connected to a main valve control chamber 114 below the main valve diaphragm 102. Gas flows into the main bleed line 118 and the main valve control chamber 114 from the gas input 104 through a bypass line 118 and a small orifice 138. An electrically controlled two position operator valve 116 opens the main bleed line 112 in the "on" position and closes the main bleed line 112 and connects the main valve control chamber 114 to the bypass line 118 in the "off" position.

The air and fuel proportioner 54 is comprised of an air inlet section 122 having a fixed diameter, a venturi throat section 124 of a diameter smaller than the diameter of the air inlet section and an exit section 126 of a diameter larger than the venturi throat section diameter. The air inlet section 122 and the venturi throat section 124 are interconnected by a tapered section 128 providing a smooth transition between these two sections.

Figure 2:
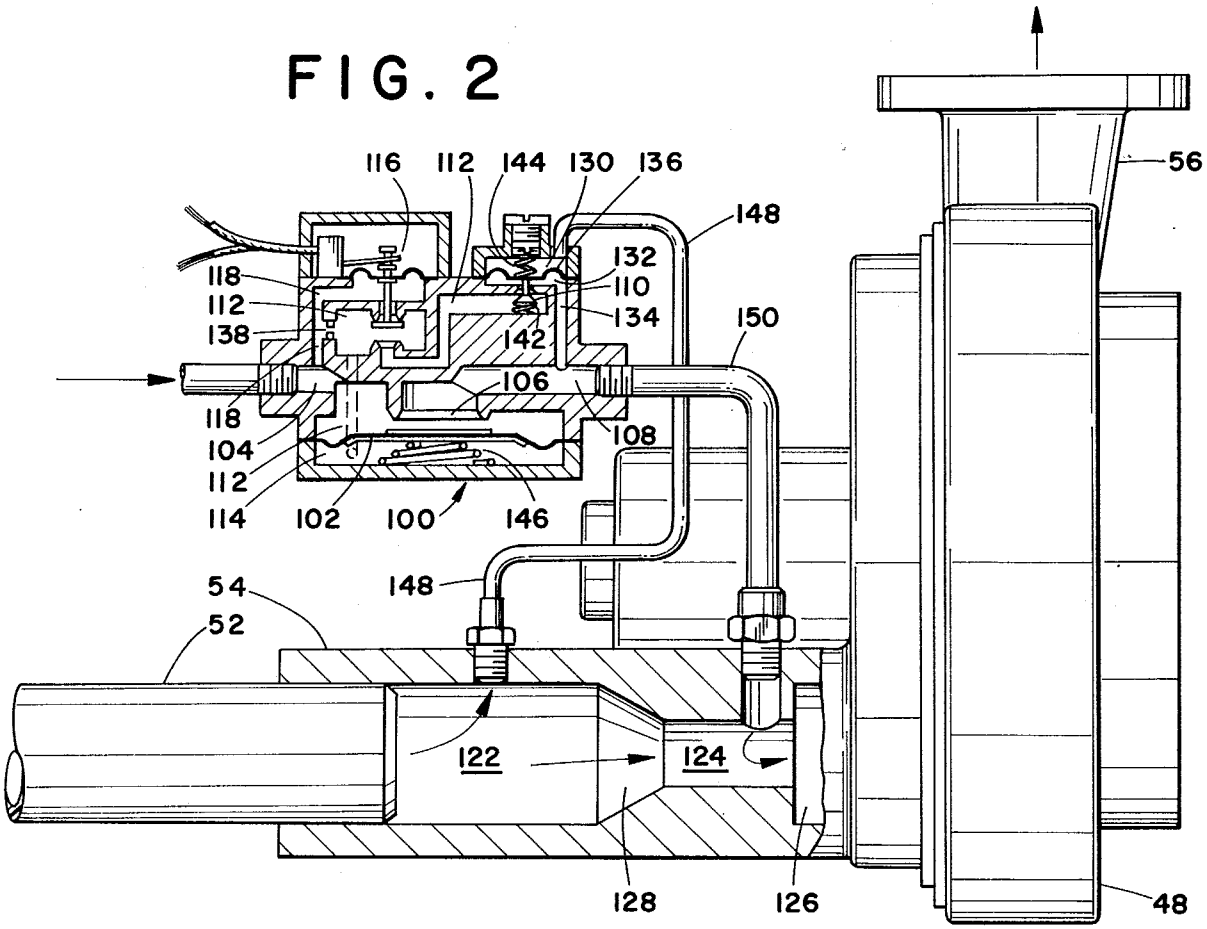
FIG. 2 is an enlarged detail drawing of the venturi air and fuel proportioner, fuel regulator and blower portions of the device in FIG. 1.

The servo regulator 100 is shown in the "on" position in FIG. 2. The flow of gas through the servo regulator is controlled such that gas pressure at the servo regulator gas output 108 is always maintained at a constant level in comparison to a reference pressure sensed in a sensing chamber 130 of the pressure sensing regulator valve 110. This is accomplished by varying the pressure in the main valve control chamber 114. If the output pressure drops below its desired pressure, this change is transmitted from the regulator output 108 to an output sensing chamber 132 in the pressure sensing regulator valve 110 through a passage 134. A diaphragm 136 separating the reference sensing chamber 130 from the output sensing chamber 132 responds to the changed pressure difference by opening the sensing regulator valve 110. The pressure in the main valve control chamber 114 is controlled by the flow of gas from the servo regulator gas input 104 through the small orifice 138 into the main bleed line 112 and through the sensing valve 110. When the sensing valve is opened, as described above, the pressure in the main bleed line 112 and the main valve control chamber 114 drops allowing the main valve diaphragm 102 to move downwardly and increasing the flow of gas through the main valve aperture 106. This increases gas flow and brings the servo regulator output pressure back up to its desired value.

An increase in pressure at the regulator output 108 closes the sensing regulator valve 110 and hence the main valve aperture 106 by increasing the pressure in the main valve control chamber 114. The servo regulator 100 thus maintains an output pressure having a constant difference from a reference pressure. This output pressure is maintained regardless of the flow rate through the main valve aperture 106 and regardless of fluctuations in input gas pressure as control is accomplished by means of a small valve regulating a small flow in a bleed line which in turn regulates a main valve. This arrangement also provides damping in response to quick small pressure changes which also improves performance.

Several valve biasing springs 142, 144 and 146 are selected and adjusted in a conventional manner to set the difference between the reference pressure and the regulator output pressure selected. In the preferred embodiment this pressure difference is set to be negligibly small when compared to other operating pressures in the system.

Pressure regulators such as that just described usually compare the gas output pressure to atmospheric pressure. In the present invention, the reference sensing chamber 130 of the sensing regulator valve 110 is connected to the air inlet section 122 of the air and fuel proportioner 54 by an air inlet pressure line 148. Thus, output pressure of the servo regulator 100 is held constant with respect to the low air pressure at the air inlet section of the air and fuel proportioner 54 which is the reference pressure referred to herein as sensed in chamber 130. The pressure difference constant selected in the preferred embodiment is 0.2 inches of water, which is negligibly small when compared to other system pressures and pressure differences when the blower 48 is in operation.

As is well known from the theory of venturi operation, when there is flow through the air and fuel proportioner 54, the pressure in the venturi throat section 124 is lower than the pressure in air inlet section 122. The differential in the pressures between the air inlet section 122 and the venturi throat section 124 is proportional to the square of the air flow rate.

The gas output 108 of the servo regulator 100 is connected to an opening in the venturi throat section 124 by a low pressure fuel line 150. The flow rate of gas through the low pressure fuel line 150, which acts as an orifice, into venturi throat section 124 is proportional to the square root of the difference in pressure between servo regulator output 108 and the venturi throat section 124. As the servo regulator output pressure is substantially equal to the pressure in the air inlet section 122, the flow of gas through the low pressure fuel line 148 and into the venturi throat section 124 is directly proportional to the flow of air through the air and fuel proportioner 54 regardless of the volume of air flow or the inlet air pressure.

The ratio of fuel to air supplied by the air and fuel proportioner 54 is determined by the sizing of the air inlet section 122, the venturi throat section 124, and the resistance to flow of the low pressure fuel line 150.

These sizes are selected in accordance with the well known theory of venturi action and known pressure regulator design parameters to select a desired air and fuel ratio. For natural gas fuel, the ratio used is one part natural gas for sixteen parts air. In the preferred embodiment of the invention above described, that ratio is held within a reasonable tolerance when the heater A is operating at an input capacity of between 10,000 and 120,000 BTU's per hour.

System Operation

When the water temperature sensor 42 informs the control circuitry in the electrical control box 44 that water heating is required, the igniter 46 is energized. Forty-five seconds later, the blower 48 is turned on and servo regulator operator valve 112 is turned on enabling the servo regulator 100. The blower 48 draws a stream of air through the air inlet tubing 52 and the air and fuel proportioner 54. The passage of air through the air and fuel mixer 54 causes a pressure differential to develop between the air inlet section 122 and the venturi throat section 124. When this pressure differential exceeds a predetermined threshold, the gas servo regulator 100 allows the passage of gas into the proportioner in an amount proportional to the amount of air flowing through the proportioner 54. The currently preferred threshold pressure differential is 0.2 inches of water. A higher threshold of 0.8 or 1.0 inches of water has some advantages, but 0.2 inches of water appears to work best at present.

The air and fuel mixture from proportioner 54 is drawn at a pressure less than ambient pressure by the blower 48, pressurized, homogenized and introduced into the burner 70. The mixture is forced through the burner screen 76 and ignited by the igniter 46. A cylindrical flame front is established outside of the burner screen 76 within the combustion chamber 14.

After 6 seconds of operation, ignition current to the igniter 46 is turned off. The igniter now functions as a combustion detector in a well known manner. If combustion is present, the blower continues to supply air and fuel to the burner until the water temperature sensor 42 indicates that no more heating is needed. If combustion is not detected, the blower is turned off and the system is reset.

The above described heater is an extremely efficient device and extremely safe. Proportioning of air and fuel occurs at pressures less than atmospheric thereby assuring that no leaking of fuel from the regulator or proportioner will occur. Moreover, because the fuel is precisely metered into the air flow based upon the amount of air actually flowing, obstructions inadvertantly or deliberately introduced into the air flow path cannot result in an overly rich mixture of air and fuel leading to incomplete combustion in the combustion chamber. Should the air flow path be partially obstructed, fuel will be metered into the air and gas proportioner at a rate appropriate to the amount of air available. The capacity of the system is reduced but its safety and efficiency are maintained at a much higher level than prior art devices. Moreover, should air flow be totally blocked, the pressure differential in the air and fuel proportioner 54 required for fuel flow will never develop and the servo regulator will not permit the flow of gas.

Importantly, all of the air and flow proportioning adjustments in this heater can be performed at the factory. Variations in installation such as variations in air intake and gas intake piping and exhaust gas piping do not effect proportioning significantly. There is no need for on-site fuel and air proportioner adjustment for such variations.

The mechanical gas pressure regulator 100 described above can be replaced by an electronic regulator which may be advantageous in certain applications. The pressure differential between the air inlet section and the venturi throat section of the air and fuel mixer is read and digitized in any of several well known manners. This signal is then used to control an electrically controlled valve or atomizing fuel injector which introduces a precisely measured amount of fuel into the airstream in the venturi throat section 124 of the air and fuel proportioner. The proportioning of fuel and air and the threshold air flow requirement described above are easily programmed into an electronic controller.

The invention has been described with reference to a preferred embodiment. Obviously, modifications and alterations will occur to others upon the reading and understanding of this specification. It is our intention to include all such modifications and alterations insofar as they come within the scope of the appended claims or the equivalents thereof.

Having thus described the invention, it is claimed:

1. A heating apparatus capable of maintaining a steady state efficiency of operation of approximately 95% over a wide range of input capacities of from about 10,000 to about 120,000 BTU's comprising:

a tank adapted to contain a body of fluid to be heated;

a sealed combustion chamber disposed within said tank having an inlet opening and an exhaust aperture;

an exhaust gas exit tube connected to said exhaust aperture and exiting said tank;

a burner disposed within said combustion chamber receiving fuel and air through said combustion chamber inlet opening;

an airtight fluid moving means having an output fixed to said combustion chamber inlet opening and having an inlet;

a venturi type air and fuel proportioner having an air inlet section of a first cross-sectional area in flow communication with a source of air, a venturi throat section of a second cross-sectional area smaller than said flow regulator output through a fuel aperture in said venturi throat section and having an outlet fixed to said fluid moving means inlet whereby a stream of air and a stream of fuel are drawn at less than standard atmospheric pressure through said air and fuel proportioner in response to operation of said fluid moving means;

said fuel regulator having an air inlet section pressure chamber connected by an air-tight tube to said air inlet section and valve means maintaining the pressure of fuel delivered to said fuel flow regulator output in fixed relationship to said air inlet section pressure and;

said air-tight fluid moving means effective to mix said air and fuel into a combustible mixture away from said proportioner and direct said mixture at pressure above standard atmosphere into said burner.

2. The heating apparatus of claim 1 wherein said fuel flow regulator additionally comprises means maintaining said fuel flow regulator output pressure substantially equal to said air inlet section pressuring during steady state operation and allowing the passage of fuel only when a predetermined pressure differential exists between said air inlet section and said venturi throat section.

3. The heating apparatus of claim 2 wherein said predetermined pressure differential is between about 0.2 inches of water and about 1.0 inch of water.

4. The heating apparatus of claim 1 wherein said fuel regulator additionally comprises means sensing air flow through said air and fuel proportioner and allowing the passage of fuel to said air and fuel proportioner only when air flow is present.

5. The heating apparatus of claim 1 wherein said burner is a cylindrical burner comprising a mounting plate fixed to said tank, a lower ring fixed to said mounting plate, a cylindrical screen disposed above said lower ring and allowing the passage of fluid from the interior of said screen to the exterior of said screen, a circular top impervious to the flow of fluid closing the top of said screen and a vertical divider adapted to prevent the swirling of fluid within said burner.

6. The heating apparatus of claim 5 wherein said combustion chamber contains an igniter on the exterior of said burner and said burner divider has a deflector adapted to direct the flow of fluid toward said igniter.

7. The apparatus of claim 1 wherein said venturi throat section is formed by a wall and said fuel aperture is an opening through said wall.

8. A high efficiency method of heating water contained in a water containing tank comprising the steps of:

providing a venturi type air and fuel proportioner having an air inlet of a first cross-sectional area adapted to receive air from outside said tank, a venturi throat section of a second cross-sectional area smaller than said first cross-sectional area having a fuel aperture therein adapted to receive fuel, and an air and fuel outlet;

providing a gas regulator adapted to receive fuel from a gas line and provide fuel to said fuel aperture, said gas regulator having an air pressure chamber in pressure sensing communication with said proportioner air inlet;

providing an air-tight fluid mover having its air input tightly connected to said proportioner outlet and an output;

providing a closed combustion chamber within said water containing tank having a burner disposed therein, said burner adapted to receive air and fuel under pressure from said fluid mover, an igniter and exhaust gas outlet;

providing an exhaust gas exit tube within said water containing tank, said exit tube being connected to said combustion chamber exhaust gas outlet, following a long convoluted path within said water containing tank and exiting said water containing tank;

providing fuel from said gas regulator to said proportioner fuel aperture from said gas regulator at a pressure substantially equal to said proportioner air inlet pressure, thereby creating an air and fuel mixture in said proportioner of constant proportion over a broad range of input air flows;

energizing said fluid moving means to forcefully draw air and fuel at a negative pressure thru said proportioner, and mix said air and fuel into a homogenized mixture at a positive pressure away from said proportioner and thereafter pass said air and fuel into said combustion chamber;

igniting said air and fuel mixture in said combustion chamber thereby creating combustion and products of combustion; and, forcing said products of combustion through said exhaust gas exit tube.

9. A heating apparatus comprising:

a tank adapted to contain a body of fluid to be heated;

a sealed combustion chamber disposed within said tank having an inlet opening and an exhaust aperture;

an exhaust gas exit tube connected to said exhaust aperture and exiting said tank;

a burner disposed within said combustion chamber receiving a combustible mixture of fuel and air from said combustion chamber inlet opening and means for igniting said combustible mixture within said combustible chamber;

proportioning means remote from said combustion chamber for drawing a metered amount of fuel and air therethrough, said proportioning means including regulator means and a venturi, said venturi having an air inlet section of a first cross-sectional area in communication with a source of air, a venturi throat section of a second cross-sectional area smaller than said first cross-sectional area and a transition section therebetween, said throat section having a fuel aperture in the wall thereof, said regulating means metering a precise amount of fuel through said fuel aperture into said throat section in fixed proportion to the amount of air flowing through said proportioning means and including an air inlet port connected by an airtight tube to said inlet section of said proportioning means, a fuel outlet port connected by a fuel-tight tube to said fuel aperture and valve means maintaining the pressure of fuel delivered to said throat section in fixed relationship to the air pressure at said air inlet port;

an airtight fluid moving means having an outlet sealed to said combustion chamber and a cylindrical inlet sealed and in fluid communication with said venturi throat section, said fluid moving means inlet having a diameter significantly larger than said venturi throat section and a distribution plate with small openings defining its outlet, said airtight fluid moving means operable to pull said fuel and air through said proportioning means at a pressure less than atmospheric and subsequently mix said fuel and air into a mixture which is combustible when said mixture impacts and is forced through said openings in said distribution plate and enters said combustion chamber, said airtight fluid moving means and said proportioning means effective to maintain a steady state efficiency of operation of approximately 95% over a range of said burner operation of anywhere between 10,000 and 120,000 BTU's per hour.

10. The burner of claim 9 wherein said valve means further includes first and second diaphragms, said first diaphragm controlling the flow of fuel to said fuel aperture said second diaphragm regulated by the pressure of said air tube on one side and a bleed passage from said fuel output on its opposite, the position of said second diaphragm controlling the position of said first diaphragm whereby gas supply pressures down to zero can be regulated by said valve means with minimum hunting of said valve means.

11. The burner of claim 10 wherein said burner includes a cylindrical burner ring having a bottom end secured to said distribution plate and a top end, a cylindrical burner screen of fine mesh welded to said top end of said cylindrical burner ring, an end cap welded to the to of said burner ring, three vertical plates extending from said distributor plate to said end cap and radiating from the center of said distribution plate to divide said burner into three compartments for reducing the noise of said combustible mixture of said fuel and air within said burner, an igniter adjacent said burner ring, and one of said vertical plates having a tab protruding therefrom to direct a portion of said combustible mixture of fuel and air through a portion of said burner screen adjacent said igniter.

* * * * *

UNITED STATES PATENT AND TRADEMARK OFFICE

CERTIFICATE OF CORRECTION

PATENT NO. : 4,766,883

DATED : August 30, 1988

INVENTOR(S) : Cameron A. Larson; Henry J. Moore

It is certified that error appears in the above-identified patent and that said Letters Patent are hereby corrected as shown below:

Title Page, Item [75] Inventors, "A. Larson Cameron" should read --- Cameron A. Larson ---. Column 2, line 4, "effecting" should read --- affecting ---; line 29, "effect" should read --- affect ---. Column 9, line 52, "inadvertantly" should read --- inadvertently ---. Column 10, line 2, "effect" should read --- affect ---; line 46, after "said" insert --- first cross-sectional area receiving fuel from a fuel ---. Column 12, line 60, before "said" insert a comma (,).

Signed and Sealed this

Thirty-first Day of January, 1989

*Attest:*

*Attesting Officer*

DONALD J. QUIGG

*Commissioner of Patents and Trademarks*